US008474515B2

(12) United States Patent
Burgers et al.

(10) Patent No.: US 8,474,515 B2
(45) Date of Patent: Jul. 2, 2013

(54) FINNED CYLINDRICAL HEAT EXCHANGER

(75) Inventors: John G. Burgers, Oakville (CA); Michael A. Martin, Hamilton (CA); Ihab Edward Gerges, Oakville (CA); Bruce L. Evans, Burlington (CA)

(73) Assignee: Dana Canada Corporation, Oakville (CA)

( * ) Notice: Subject to any disclaimer, the term of this patent is extended or adjusted under 35 U.S.C. 154(b) by 683 days.

(21) Appl. No.: 12/355,138

(22) Filed: Jan. 16, 2009

(65) Prior Publication Data

US 2010/0181052 A1 Jul. 22, 2010

(51) Int. Cl.
*F28D 7/02* (2006.01)

(52) U.S. Cl.
USPC ..... 165/164; 165/154; 165/157; 165/96; 165/109.1

(58) Field of Classification Search
USPC ..... 165/154, 157, 164, 96, 109.1
See application file for complete search history.

(56) References Cited

U.S. PATENT DOCUMENTS

| | | | | |
|---|---|---|---|---|
| 744,111 | A | 11/1903 | Roderwald | |
| 813,918 | A * | 2/1906 | Schmitz | 165/154 |
| 2,703,921 | A * | 3/1955 | Brown, Jr. | 165/141 |
| 2,707,096 | A | 4/1955 | Koopmans | |
| 3,015,475 | A | 1/1962 | Meijer et al. | |
| 3,335,789 | A | 8/1967 | Raskin | |
| 3,868,994 | A * | 3/1975 | Petrek | 165/142 |
| 4,059,882 | A * | 11/1977 | Wunder | 165/154 |
| 4,096,616 | A * | 6/1978 | Coffinberry | 165/154 |
| 4,448,243 | A | 5/1984 | Pain | |
| 4,592,415 | A | 6/1986 | Friedman | |
| 4,635,707 | A * | 1/1987 | Gentry | 165/96 |
| 4,945,981 | A | 8/1990 | Joshi | |
| 5,538,075 | A | 7/1996 | Eubank et al. | |
| 5,743,091 | A | 4/1998 | Penswick et al. | |
| RE35,890 | E | 9/1998 | So | |
| 5,918,463 | A | 7/1999 | Penswick et al. | |
| 5,920,133 | A | 7/1999 | Penswick et al. | |
| 6,012,514 | A | 1/2000 | Swain | |
| 6,019,168 | A | 2/2000 | Kinnersly | |
| 6,050,092 | A | 4/2000 | Genstler et al. | |
| 6,273,183 | B1 | 8/2001 | So et al. | |
| 6,585,034 | B2 | 7/2003 | Oswald | |
| 7,007,749 | B2 | 3/2006 | Brost et al. | |
| 7,191,824 | B2 | 3/2007 | Wu et al. | |
| 2001/0045275 | A1 | 11/2001 | Banno et al. | |
| 2005/0109493 | A1 * | 5/2005 | Wu et al. | 165/157 |
| 2005/0155748 | A1 | 7/2005 | Seager | |
| 2007/0196704 | A1 | 8/2007 | Valensa et al. | |

* cited by examiner

*Primary Examiner* — Cheryl J Tyler
*Assistant Examiner* — Orlando E Aviles Bosques
(74) *Attorney, Agent, or Firm* — Marshall & Melhorn, LLC

(57) ABSTRACT

A cylindrical heat exchanger for use as a gas cooler in a thermal regenerative machine such as a Stirling engine includes an imperforate middle wall of sufficient strength and thickness to withstand the pressure exerted by the working fluid. The heat exchanger includes an inner corrugated wall located within an axial gas flow passage inside the middle wall, and an outer corrugated wall which defines an axial coolant flow passage along the outer surface of the middle wall. The coolant flow passage preferably contains a corrugated intermediate wall.

27 Claims, 17 Drawing Sheets

30
72
10
44
68
56
12
34
54
52
46
90
110
76

92
96
94
18

T
224
200
L
226
W
H

FINNED CYLINDRICAL HEAT EXCHANGER

FIELD OF THE INVENTION

The invention relates to cylindrical, gas-to-liquid heat exchangers, suitable for use in Stirling engines and in other applications.

BACKGROUND OF THE INVENTION

In a Stirling cycle electric power generator a movable displacer moves reciprocally within the generator housing, transferring a pressurized working fluid such as helium back and forth between a low temperature contraction space and a high temperature expansion space. A gas cooler is provided adjacent to the pressure wall of the compression space to extract heat from the working fluid as it flows into the compression space. In conventional constructions the gas cooler may be in the form of an annular bundle of thin-walled tubes, the construction of which requires a large number of brazed connections. The large numbers of brazed joints, coupled with high internal working gas pressures, can lead to an increased likelihood of failure in this type of heat exchanger. Heat transfer is also limited in the tube bundle structure.

SUMMARY OF THE INVENTION

In one aspect, the invention provides a heat exchanger comprising a cylindrical middle wall open at both ends and extending along an axis, wherein the middle wall has an inner surface and an outer surface and is free of perforations. The heat exchanger further comprises an inner wall located inwardly of the middle wall and being attached to the inner surface of the middle wall, wherein the inner wall is curved so as to follow the curvature of the middle wall, and wherein one or more axially-extending spaces are provided between the inner wall and the middle wall. A first fluid flow passage includes the one or more axially-extending spaces between the inner wall and the middle wall, wherein the first fluid flow passage is open at its axially-spaced ends. The heat exchanger further comprises an outer wall located outwardly of the middle wall and being curved so as to follow the curvature of the middle wall, wherein one or more axially-extending spaces are provided between the middle wall and the outer wall. A second fluid flow passage includes the one or more axially-extending spaces between the middle wall and the outer wall, wherein the second fluid flow passage has first and second open ends. The heat exchanger further comprises a first manifold in flow communication with the first open end of the second fluid flow passage, wherein the first manifold is provided with a first fluid opening; and a second manifold in flow communication with the second open end of the second fluid flow passage, wherein the second manifold is provided with a second fluid opening.

BRIEF DESCRIPTION OF THE DRAWINGS

The invention will now be described, by way of example only, with reference to the accompanying drawings, in which.

DETAILED DESCRIPTION

In the following description, several embodiments of heat exchangers according to the invention are described. The heat exchangers described below are specifically adapted for use as gas cooling heat exchangers in thermal regenerative machines such as Stirling engines. It will, however, be appreciated that heat exchangers of the type described below are not restricted for use in Stirling engines, but rather may be used as gas-to-liquid heat exchangers in numerous other applications.

Figure 1:
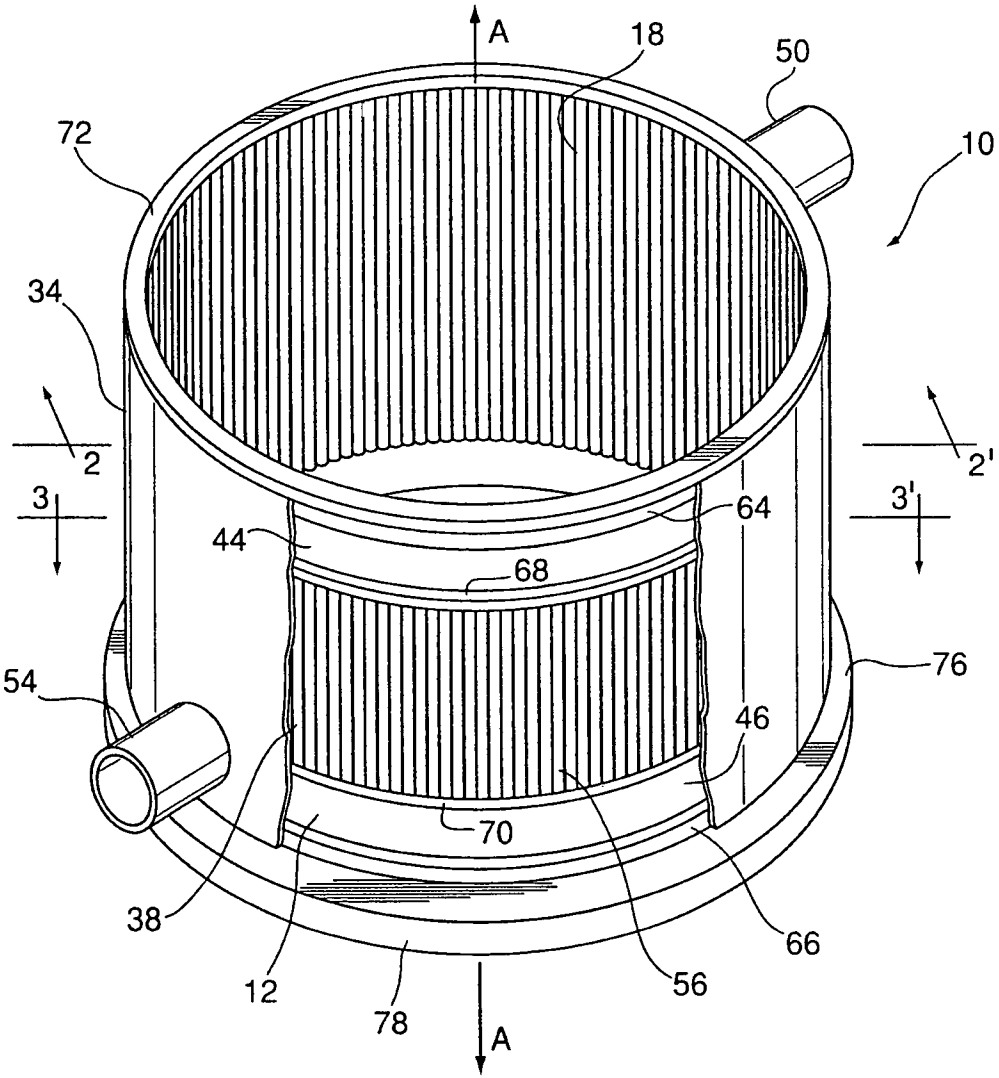
FIG. 1 is a partly cut-away perspective view of a heat exchanger according to a first embodiment of the invention.

Illustrated in FIG. 1 is a heat exchanger 10 according to a first embodiment of the invention. Heat exchanger 10 is generally in the shape of an open-ended, hollow cylinder having a sidewall which is comprised of at least three generally cylindrical layers. The sidewall of heat exchanger 10 extends parallel to a longitudinal axis A passing centrally through the hollow interior space of heat exchanger 10. In the following description, the terms such as "axial" and the like refer to directions which are parallel to the axis A, and terms such as "inner", "outer", "inward" and "outward" and the like refer to radial directions extending outwardly from or inwardly toward axis A, and which are transverse to axis A.

Figure 2:
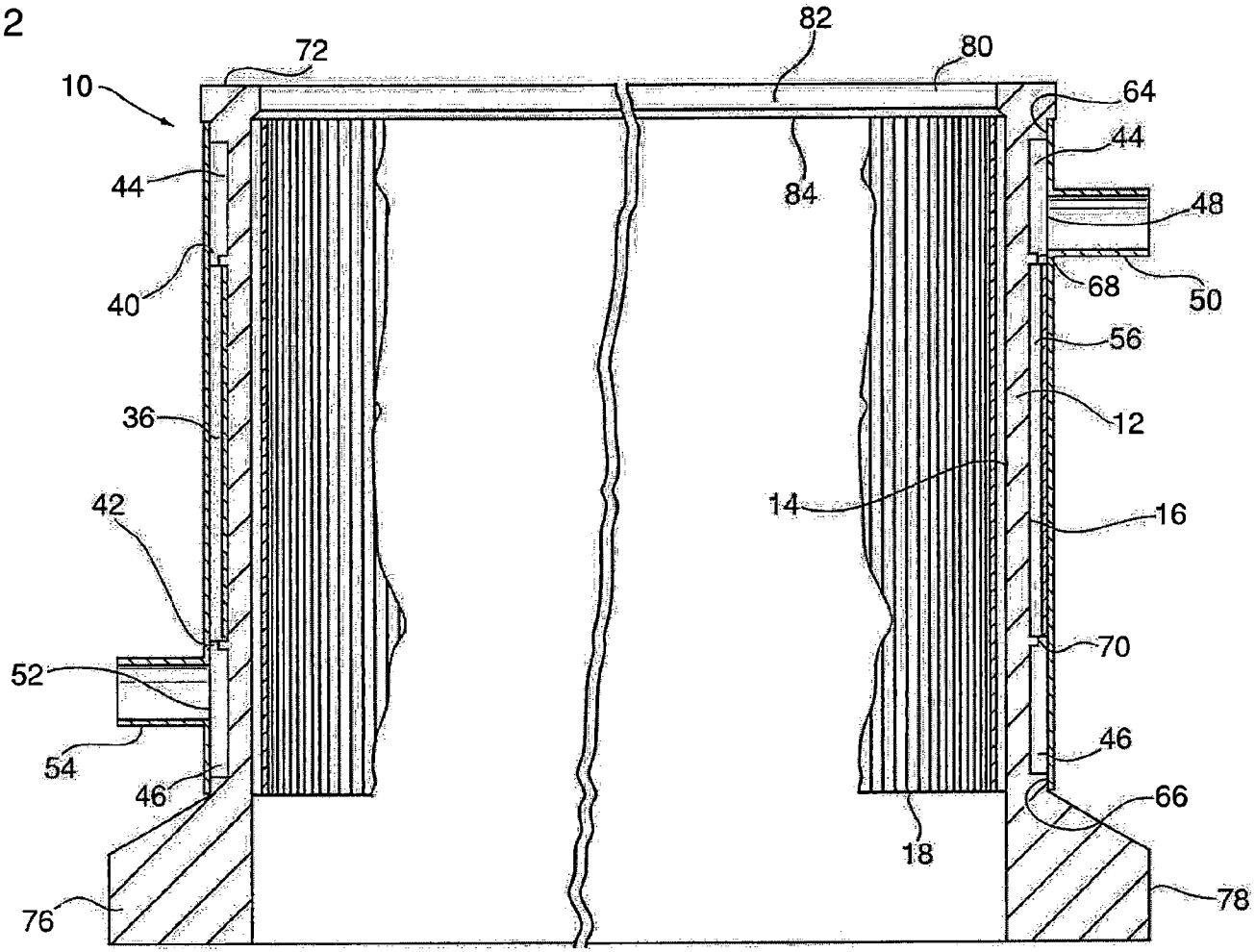
FIG. 2 is a cross-section along line 2-2' of FIG. 1.

Heat exchanger 10 includes a cylindrical middle wall 12, best seen in FIG. 2, which is open at both ends and parallel to axis A. The middle wall 12 has an inner surface 14 and an opposed outer surface 16, both of which may be smooth and free of perforations. Where the heat exchanger 10 is adapted for use in a Stirling engine, for example, the middle wall 12 of heat exchanger 10 may comprise a pressure wall which is of sufficient strength and thickness to contain the pressure exerted by the working fluid, which may be at a pressure of from about 40-60 bar. For this reason, the middle wall 12 may be the thickest layer in the sidewall construction of heat exchanger 10, although this is not necessarily the case in all constructions.

The heat exchanger 10 further comprises an inner wall 18 which is located inwardly of middle wall 12 and is in heat exchange contact with the inner surface 14 of the middle wall 12. The inner wall 18 is curved so as to follow the curvature of the middle wall 12 and, in the embodiments shown in the drawings, the inner wall 18 is generally cylindrical in shape so as to extend along the entire circumference of middle wall 12, although this is not necessarily the case. Rather, in some embodiments of the invention it may be desired that the inner wall 18 extends only along one or more discrete portions of the inner surface 14 of middle wall 12.

The inner wall 18 may be in direct contact with the inner surface 14 of middle wall 12 at a plurality of points along its circumference, and may be secured to the inner surface 14 at said plurality of points, for example by brazing. In the first embodiment of the invention, the inner wall 18 comprises a corrugated fin having a plurality of axially-extending ridges 24, 26 connected by side walls 28, best seen in the enlarged view of FIG. 4. More specifically, inner wall 18 may comprise a plurality of first axially-extending ridges 24 through which the inner wall 18 is in contact with or secured to the middle wall 12, a plurality of second axially-extending ridges 26 which are spaced inwardly from the first ridges 24, and side walls 28 interconnecting the first and second ridges 24, 26. In this embodiment of the invention the ridges 24, 26 are rounded although, as discussed further below, other configurations are possible. With the first ridges 24 contacting or secured to the inner surface 14 of middle wall 12, a plurality of axially-extending spaces 20 are provided between the inner wall 18 and the middle wall 12. Each of the axially-extending spaces 20 is defined by the inner surface 14 of middle wall 12, a pair of adjacent side walls 28 and one of the second ridges 26 to which the adjacent side walls 28 are connected.

Figure 4:
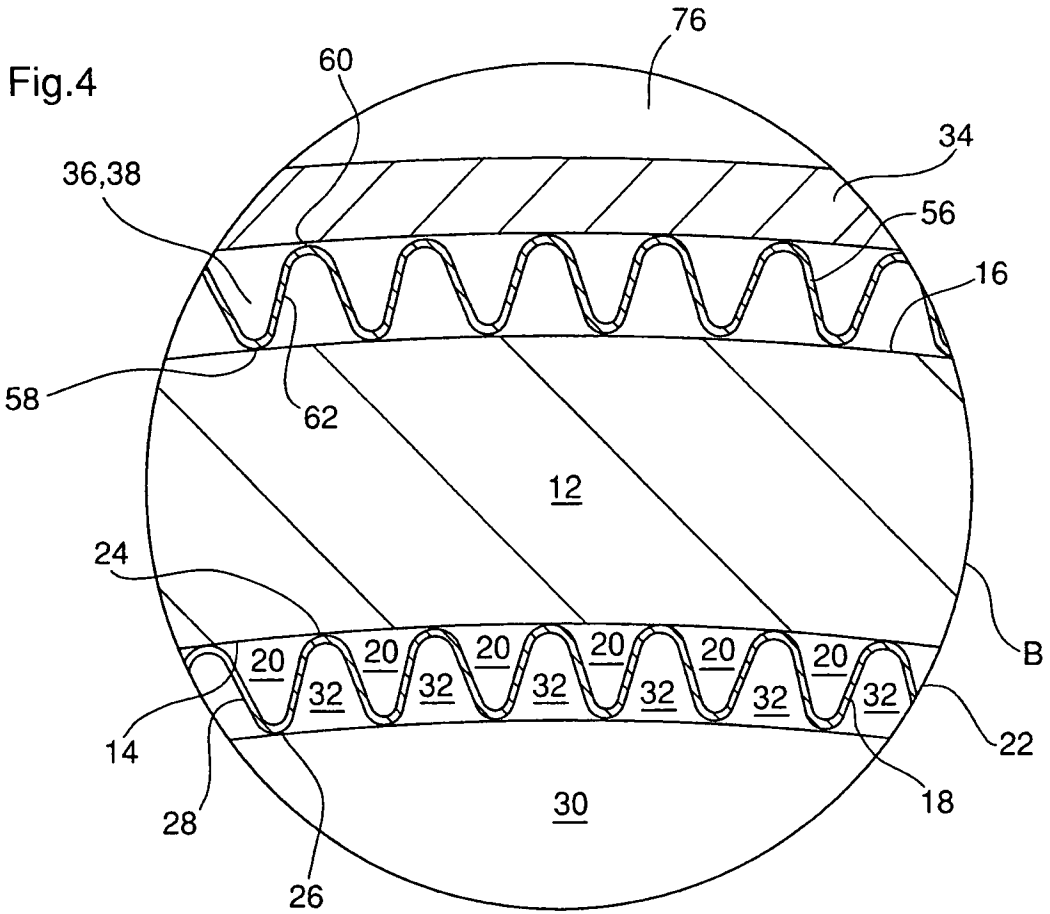
FIG. 4 is an enlarged view of area B of FIG. 3.

The axially-extending spaces 20 together form at least part of a first fluid flow passage 22 for axial flow of a gas to be cooled, such as the working fluid of a Stirling engine, which may comprise helium. In the embodiments shown in the drawings, the first fluid flow passage 22 is annular, and is further described below.

Where the cylindrical heat exchanger 10 is incorporated into a Stirling engine, its hollow center may be substantially completely filled by another cylindrical structure such as a housing 30 (a portion of which is schematically shown in FIG. 4) which may encase one or more other components of the Stirling engine. The housing 30 is a stationary component which forms a close fit with the inner wall 18 of heat exchanger 10, and is either in very close proximity to and/or in contact with the inner wall 18 along its circumference. The first fluid flow passage 22 in this embodiment is defined by the entire annular space between the housing 30 and the inner surface 14 of middle wall 12, within which the inner wall 18 is located. Therefore, in the first embodiment of the invention, where the inner wall 18 comprises a corrugated fin, the first fluid flow passage 22 comprises the axially-extending spaces 20 between the middle wall 12 and inner wall 18, and also comprises similarly configured axially-extending spaces 32 between the housing 30 and inner wall 18. As shown in the enlarged view of FIG. 4, the second ridges 26 of inner wall 18 may either be in contact with the housing 30 or in close proximity thereto, such that the radial height of the inner wall 18 (i.e. the radial distance between the first and second ridges 24 and 26) is substantially the same as the radial height of the annular space defining the first fluid flow passage 22 (i.e. the radial distance between housing 30 and middle wall 12), thus maximizing the surface area within the first fluid flow passage 22 through which heat may be extracted from the working fluid.

The heat exchanger 10 further comprises an outer wall 34 which is spaced outwardly from the middle wall 12 and is curved so as to follow the curvature of the middle wall 12, with an annular space 36 being formed between the middle wall 12 and outer wall 34. A second fluid flow passage 38 is defined within the annular space 36, having first and second open ends 40 and 42 and being configured for axial flow of a liquid coolant, such as a mixture of glycol and water, to which heat is transferred from the hot working gas.

In the embodiments shown in the drawings, the outer wall 34 is smooth and generally cylindrical in shape. It will, however, be appreciated that this is not necessarily the case, and that the outer wall 34 may be formed from one or more segments, each of which extends along a discrete portion of the circumference of middle wall 12, such that the space 36 is made up of two or more portions, each comprising a section of an annulus.

The heat exchanger 10 further comprises first and second manifolds 44, 46, best seen in FIG. 2, which are located within annular space 36 and are in flow communication with the open ends 40, 42 of the second fluid flow passage 38. More specifically, the first manifold 44 communicates with the first open end 40 of flow passage 38 and the second manifold 46 communicates with the second open end 42 of flow passage 38.

Each of the manifolds 44, 46 is provided with a fluid opening through which a liquid coolant either enters or exits the second fluid flow passage 38. As shown in FIG. 2, the first manifold 44 is provided with a first fluid opening 48 having a fitting 50 for attachment to a coolant conduit (not shown), and the second manifold 46 is provided with a second fluid opening 52 provided with a fitting 54 for connection to another coolant conduit (not shown). For the purpose of describing heat exchanger 10 it will be assumed that fluid opening 48 is the inlet opening, fitting 50 is the inlet fitting and manifold 44 is the inlet manifold. Similarly, it will be assumed that fluid opening 52 is the outlet opening, fitting 54 is the outlet fitting, and manifold 46 is the outlet manifold. It will be appreciated, however, that the flow of coolant may be reversed, if desired.

Figure 2A:
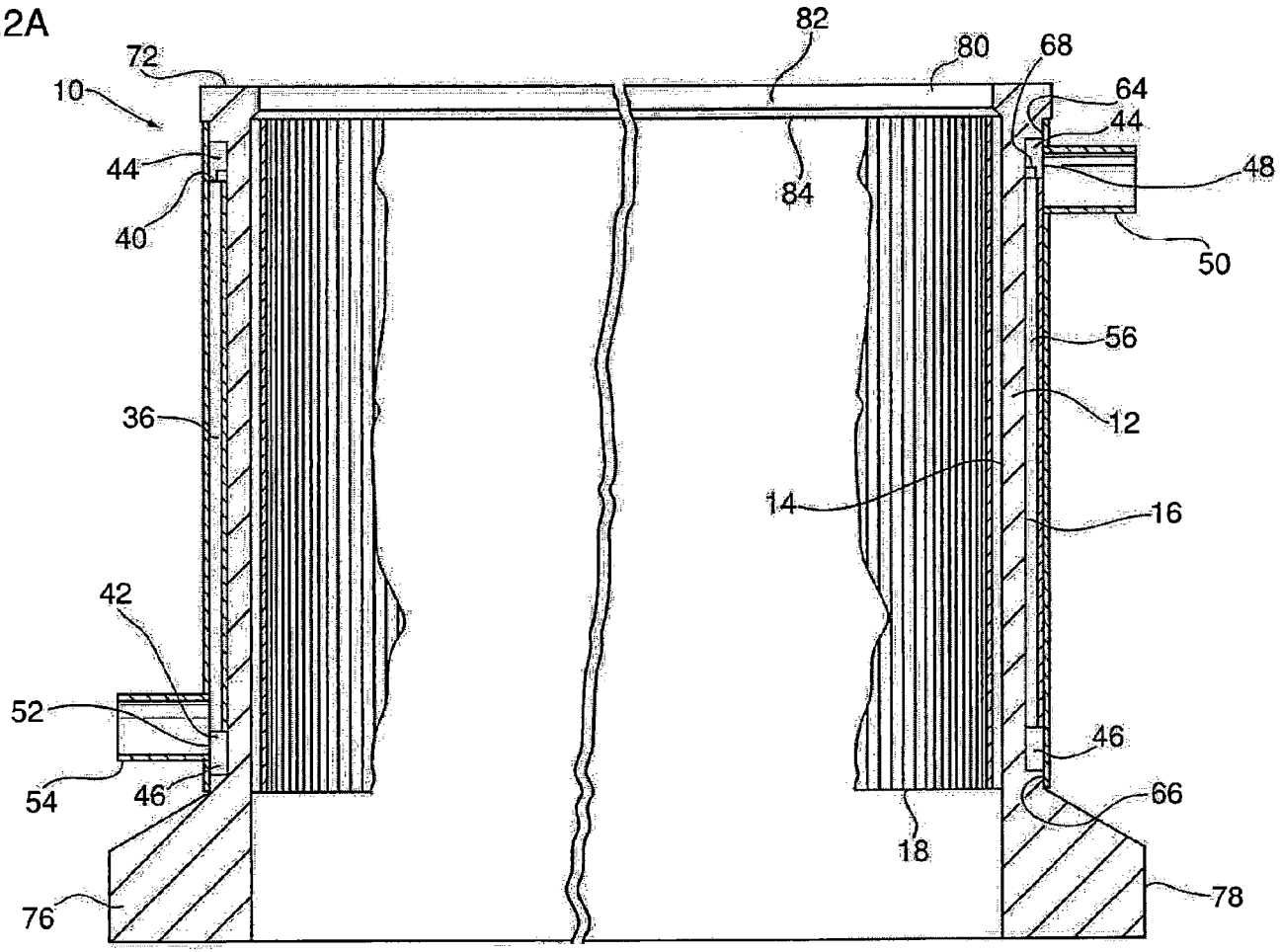
FIG. 2A is a cross-section, similar to FIG. 2, illustrating a variant of the first embodiment.
Figure 3:
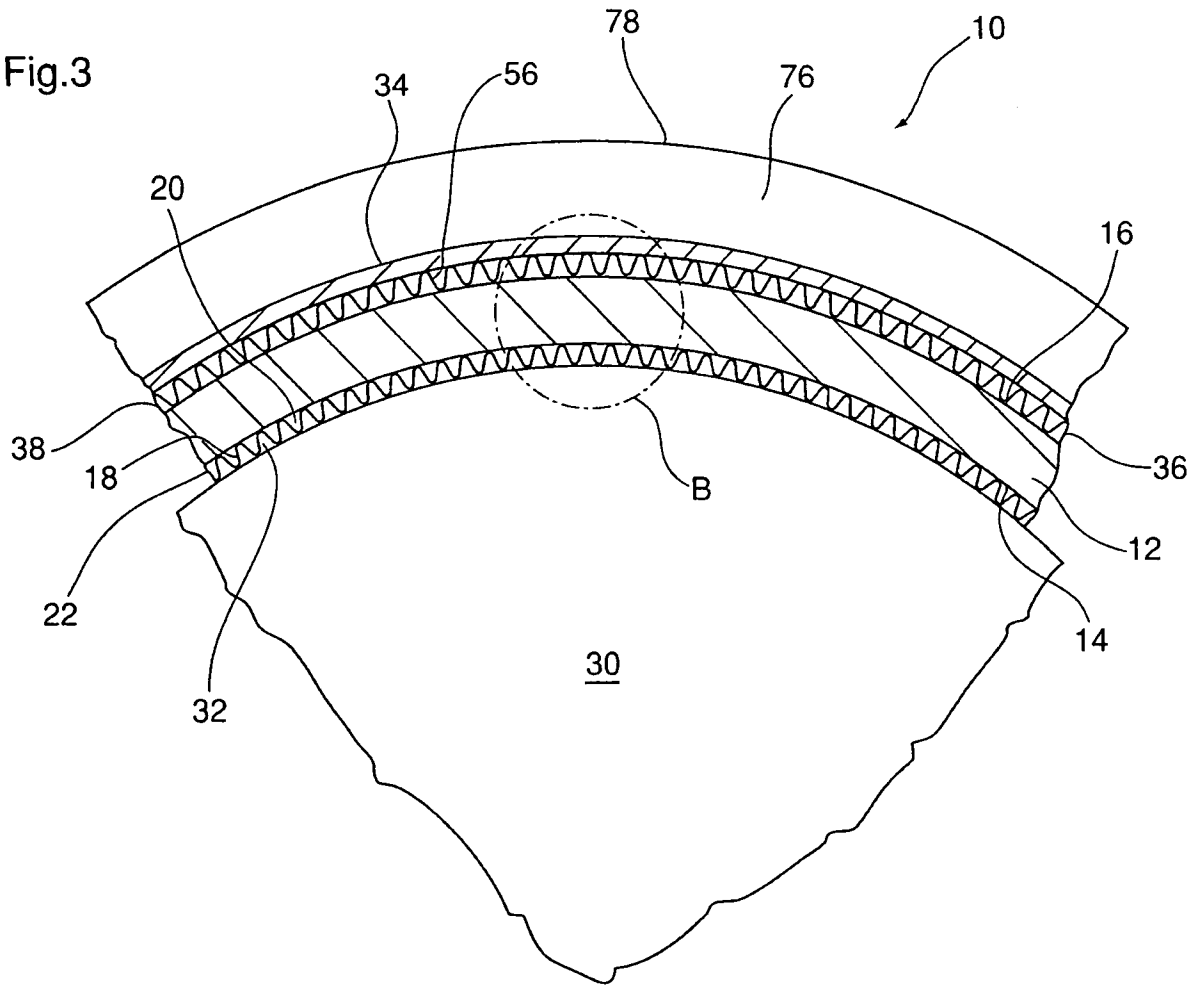
FIG. 3 is a partial cross-section along line 3-3' of FIG. 1.

The liquid coolant entering the heat exchanger 10 through inlet opening 48 is distributed about the circumference of the heat exchanger 10 through the inlet manifold 44, and then flows axially through the second fluid flow passage 38 to manifold 46 at the opposite end of the second fluid flow passage 38, from which it exits the heat exchanger 10 through the other fluid opening 52. In order to provide an optimal circumferential distribution of liquid coolant, the first and second fluid openings 48 and 52 may be circumferentially spaced from one another, for example by an angle of about 180°, as shown in FIGS. 1, 2 and 2A, although this is not necessarily the case. For example, as further discussed below, the fluid openings 48, 52 in heat exchanger 10 can be circumferentially aligned with one another, or circumferentially spaced apart by angles of less than 180 degrees, so long as a sufficient fluid distribution is maintained in the manifolds 44, 46.

As shown in the cross-section of FIG. 2, an intermediate outer wall 56 is provided in the second fluid flow passage 38 between the outer wall 34 and the middle wall 12. The intermediate outer wall 56 is in the form of a corrugated fin which may have the same shape and dimensions as the inner wall 18 of heat exchanger 10. As best seen in FIG. 4, the intermediate outer wall 56 has a plurality of first axially-extending ridges 58 which are in contact with or secured to the outer surface 16 of middle wall 12, a plurality of second axially-extending ridges 60 which are in contact with or secured to the outer wall 34, and a plurality of side walls 62 interconnecting the ridges 58, 60. The ridges 58, 60 of wall 56 extend axially from one end 40 to the other end 42 of the second fluid flow passage 38. The intermediate outer wall 56 preferably extends throughout the entire circumference of the second fluid flow passage 38 and functions to increase heat transfer to the liquid coolant in the second fluid flow passage 38.

The annular space 36 between the outer wall 34 and middle wall 12 defines the second fluid flow passage 38 as well as the two manifolds 44, 46. In the construction shown in FIGS. 1 to 4, the outer surface 16 of middle wall 12 is provided with a pair of radial ridges 64, 66 extending outwardly from the middle wall 12 and running along its entire circumference. The ridges 64, 66 are axially spaced from one another and are located proximate to the open ends of the middle wall 12. The outer wall 34 is sealingly secured to both radial ridges 64, 66 in a fluid-tight manner. The ridges 64, 66 therefore function to seal the ends of annular space 36, to secure the outer wall 34 to the middle wall 12, and to maintain a desired spacing between the middle and outer walls 12, 34. In this regard, the ridges 64, 66 preferably have a radial height substantially equal to the radial height of the corrugated intermediate outer wall 56 (i.e. the radial distance between the first and second ridges 58 and 60), so that the intermediate outer wall 56 substantially completely fills the second fluid flow passage 38.

The intermediate outer wall 56 extends between the ends 40, 42 of the second fluid flow passage 38, and the area of the outer surface 16 of middle wall 12 over which the intermediate outer wall 56 extends is preferably maximized so as to maximize heat transfer. In the variant of heat exchanger 10 shown in FIG. 2 the intermediate outer wall 56 does not substantially extend into the fluid openings 48, 52, so that the fluid openings 48, 52 are formed entirely in the portions of the annular space 36 which define manifolds 44 and 46. Therefore, in this variant of heat exchanger 10, the ends 40, 42 of the second fluid flow passage 38 are spaced from the edges of fluid openings 48, 52. In the variant of FIG. 2A, however, the axial length of the intermediate outer wall 56 is increased so as to occupy a greater area of the outer surface 16 of the middle wall, which would be expected to have a beneficial impact on heat transfer. In this variant of heat exchanger 10, the ends 40, 42 of the second fluid flow passage 38 extend into the fluid openings 48, 52.

It will be appreciated that it may be possible to increase or decrease the entrance and exit flow restrictions at the ends 40, 42 of the second fluid flow passage 38 by varying the degree by which the intermediate outer wall 56 obstructs, or extends into, the fluid openings 48, 52. For example, in some embodiments of the invention, the axial length of wall 56 throughout most of the circumference of heat exchanger 10 may be as shown in FIG. 2A, with the wall 56 being notched or otherwise reduced in length in the vicinity of the fluid openings 48, 52. This would reduce the degree by which the wall 56 obstructs openings 48, 52 and would be expected to provide lower entrance and exit flow restrictions at the ends 40, 42 of the second fluid flow passage 38.

In order to optimize the circumferential flow distribution within manifolds 44, 46, the end 40 of the second fluid flow passage 38 which is closest to the coolant inlet opening 48 may be partially restricted so as to promote circumferential distribution of the fluid throughout manifold 44 before the coolant enters the second fluid flow passage 38. The amount of restriction at the end 40 of second fluid flow passage 38 may be varied along the circumference of heat exchanger 10 so as to optimize the circumferential distribution of coolant. For example, the amount of restriction may be maximized close to the inlet opening 48 and minimized at a spacing of 180 degrees from the inlet opening 48.

FIGS. 1, 2, and 2A illustrate means for restricting the open area at the end 40 of the second fluid flow passage 38, in the form of a flow restricting rib 68. The height of the rib may be varied along the circumference of heat exchanger 10 so as to vary the amount of restriction at the opening 40 of second fluid flow passage 38. In this regard, the height of rib 68 may be at a maximum close to the inlet opening 48 and may be at a minimum at a spacing of 180 degrees from inlet opening 48. In this regard, the minimum height of rib 68 may be zero, such that the rib is discontinuous. See FIGS. 6B-6E.

It will be appreciated that flow restricting rib 68 may also function to maintain the position of the intermediate outer wall 56 during assembly of heat exchanger 10. As shown in FIG. 2 it may also be desired to provide a second locating rib 70 at the other end of intermediate outer wall 56 extending along at least a portion of the circumference of middle wall 12. Locating rib 70 has a radial height which is preferably less than one half the radial height of the intermediate outer wall 56 so as to minimize any obstruction of the second fluid flow passage 38.

In addition to ridges 64, 66 and ribs 68, 70, the middle wall 12 of heat exchanger 10 may be provided with a number of other features, which are now briefly described. Firstly, the ends of the middle wall 12 are provided with one or more axially and/or radially extending surfaces along which the heat exchanger 10 may be joined to adjacent components of the Stirling engine. For example, a first end of middle wall 12 may be provided with a flat radially-extending surface 72 along which the middle wall 12 may be joined to an adjacent cylindrical component (not shown) of the Stirling engine. Also, a second end of the middle wall 12 may be provided with an outwardly-extending connecting ridge 76 having an axial surface 78 along which the middle wall may be joined to an adjacent cylindrical component (not shown) of the Stirling engine. It will be appreciated that the configuration of the ends of the middle wall 12 may vary from that shown in the drawings, depending on the specific configurations of the adjoining components of the Stirling engine. It is preferred that structural connections between heat exchanger 10 and adjacent components of the Stirling engine are made through the middle wall 12 because it is structurally stronger than the other walls 18, 34, 56 making up heat exchanger 10.

The middle wall 12 of heat exchanger 10 may also be provided with an inwardly-extending lip 80 proximate to one of its ends, the lip 80 having an axial surface 82 for connection to an adjacent component (not shown) of the Stirling engine. The lip 80 may have a beveled or chamfered inner surface 84 abutting an end of the inner wall 18, the bevel or chamfer being provided so as to avoid obstructing the end of the first fluid flow passage 22.

Figure 5:
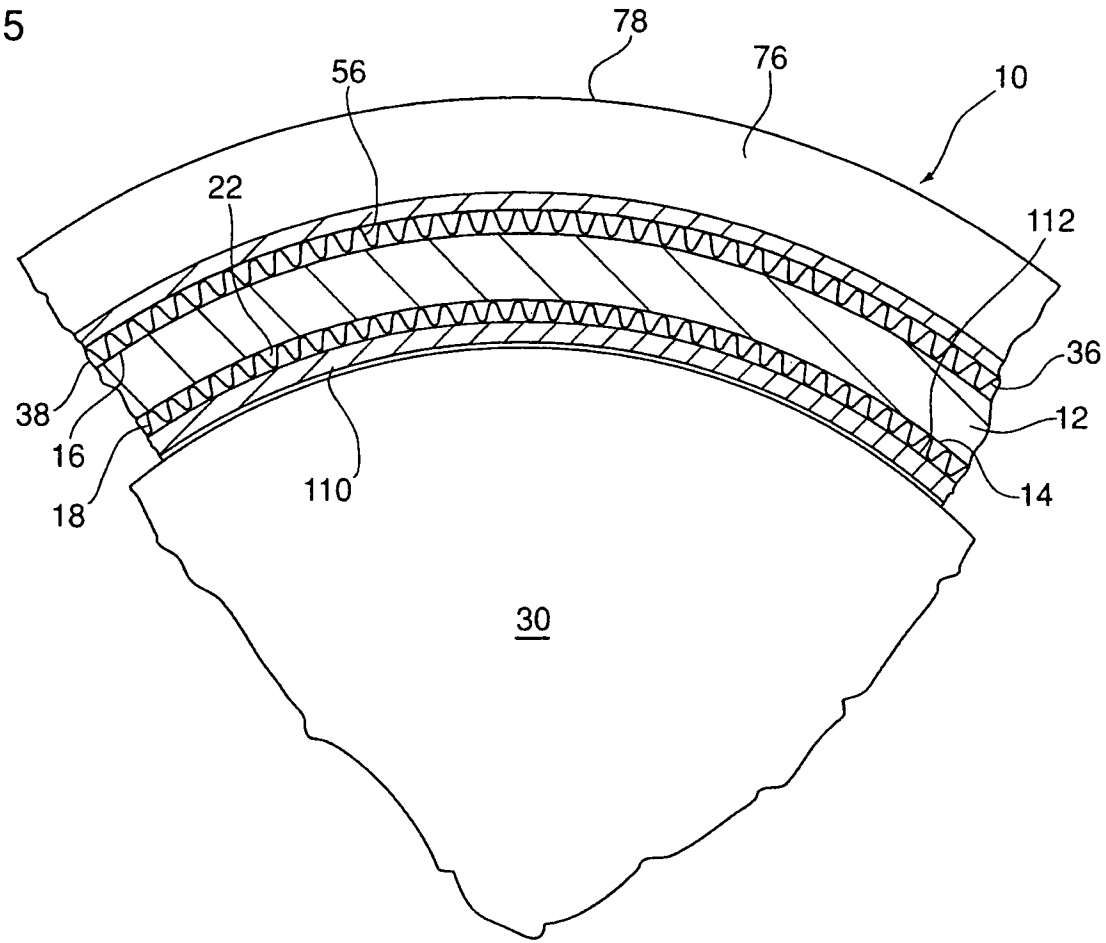
FIG. 5 is a partial cross-section, similar to FIG. 3, showing a heat exchanger according to a variant of the first embodiment.

Although heat exchanger 10 is described above as having a single inner wall 18 located inwardly of the middle wall 12, it will be appreciated that this is not necessarily the case. Rather, as illustrated in FIG. 5, heat exchanger 10 may be provided with a second inner wall 110, which forms an inner liner of the heat exchanger 10. The second inner wall 110 may comprise a smooth cylindrical sidewall (only a portion of which is shown in FIG. 5) spaced from the middle wall 12 and having an outer surface 112 which is in contact with or secured to the second ridges 26 of the inner wall 18. The second inner wall 110 may be constructed from a single piece, i.e. in the form of a tube, so as to form a smooth, continuous lining over the inner wall 18. Alternatively, the second inner wall 110 may be constructed from two or more curved segments with or without gaps left between adjacent segments.

Figures 5A, 5B, 5C:
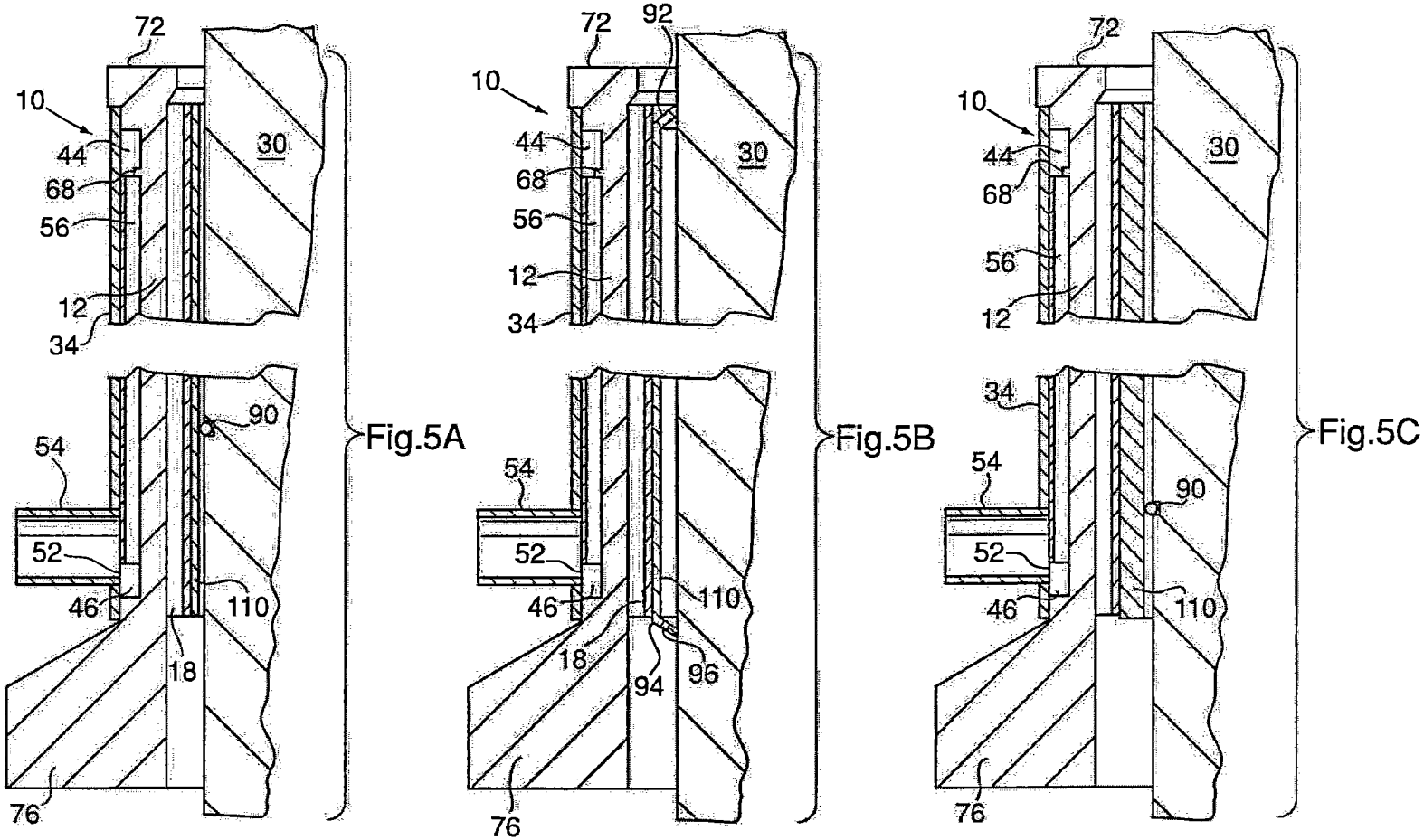
FIG. 5A is a side view illustrating a first means for sealing the heat exchanger of FIG. 5 to an internal housing of a Stirling engine.
FIG. 5B is a side view illustrating a second means for sealing the heat exchanger of FIG. 5 to an internal housing of a Stirling engine.
FIG. 5C is a side view illustrating a third means for sealing the heat exchanger of FIG. 5 to an internal housing of a Stirling engine.

The provision of second inner wall 110 may assist in achieving desired spacing tolerances between the heat exchanger 10 and the housing 30 of the Stirling engine and/or sealing any gaps between the heat exchanger 10 and housing 30. As shown in FIG. 5A, the second inner wall 110 may, for example, comprise a thin-walled tube which is first inserted into the hollow center of heat exchanger 10 and then mechanically expanded into intimate contact with the second ridges 26 of inner wall 18. Alternatively, as shown in FIG. 5C, the second inner wall 110 may comprise a relatively thick-walled tube, machined to desired tolerances, which is press fit into the hollow center of heat exchanger 10.

Optionally, as shown in FIGS. 5A and 5C, the outer surface of housing 30 may be provided with a sealing element, such as an O-ring 90, which forms a seal against the smooth, continuous surface provided with the second inner wall 110. In an alternative construction, shown in FIG. 5B, the second inner wall may be provided with an inwardly projecting edge at one or both of its ends. In the variant shown in FIG. 5B, inwardly projecting edges 92, 94 are provided at both ends of the second inner wall 110. The inwardly projecting edges 92, 94 are in contact with and form a seal with the housing 30. In order to avoid trapping air between the second inner wall 110 and housing 30, one of the inwardly projecting edges 92 or 94 may be discontinuous or may be provided with breather holes 96 so as to permit the working fluid to enter the space between the housing 30 and the second inner wall 110 and thereby prevent air from becoming trapped between the housing 30 and wall 110.

Figure 6:
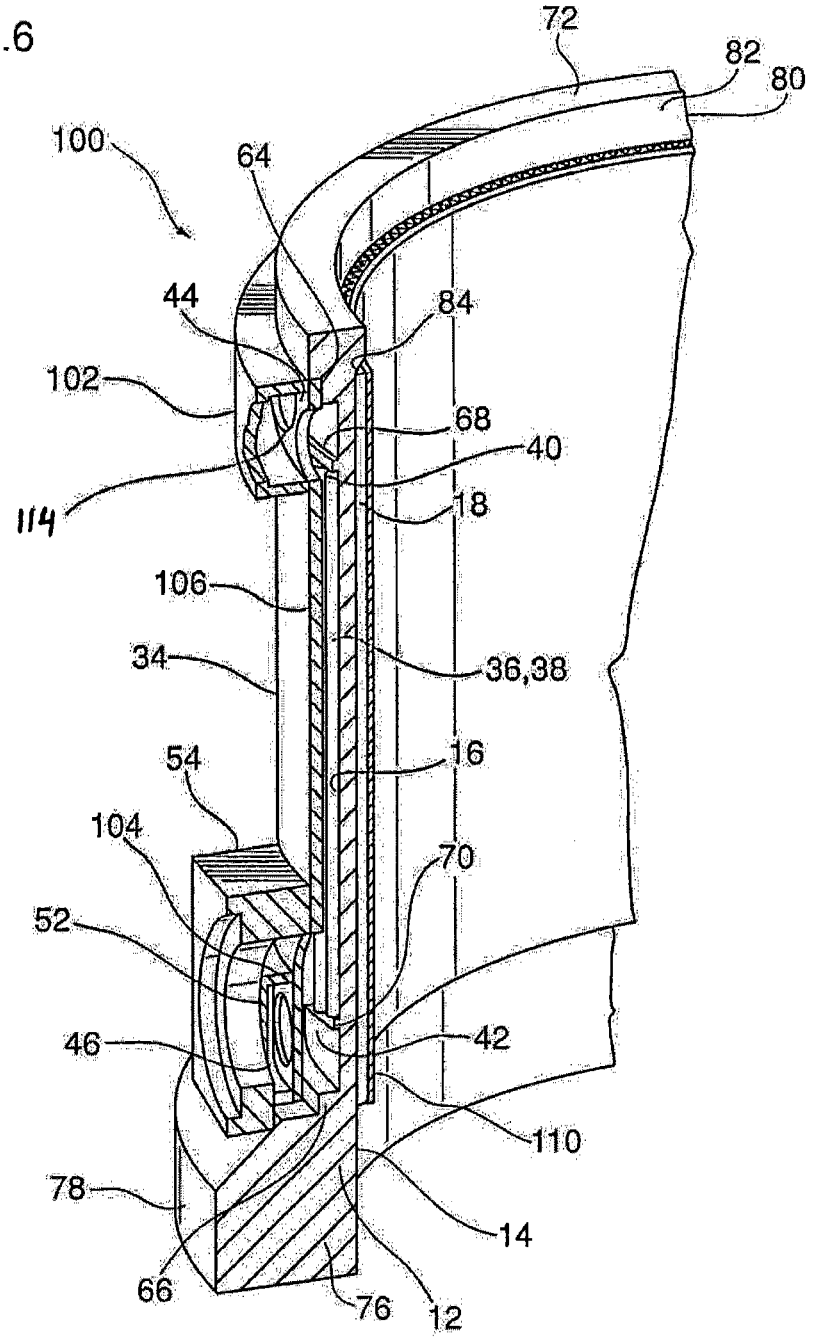
FIG. 6 is a partial, cross-sectional perspective view showing the sidewall construction of a heat exchanger according to a second embodiment of the invention.
Figure 6A:
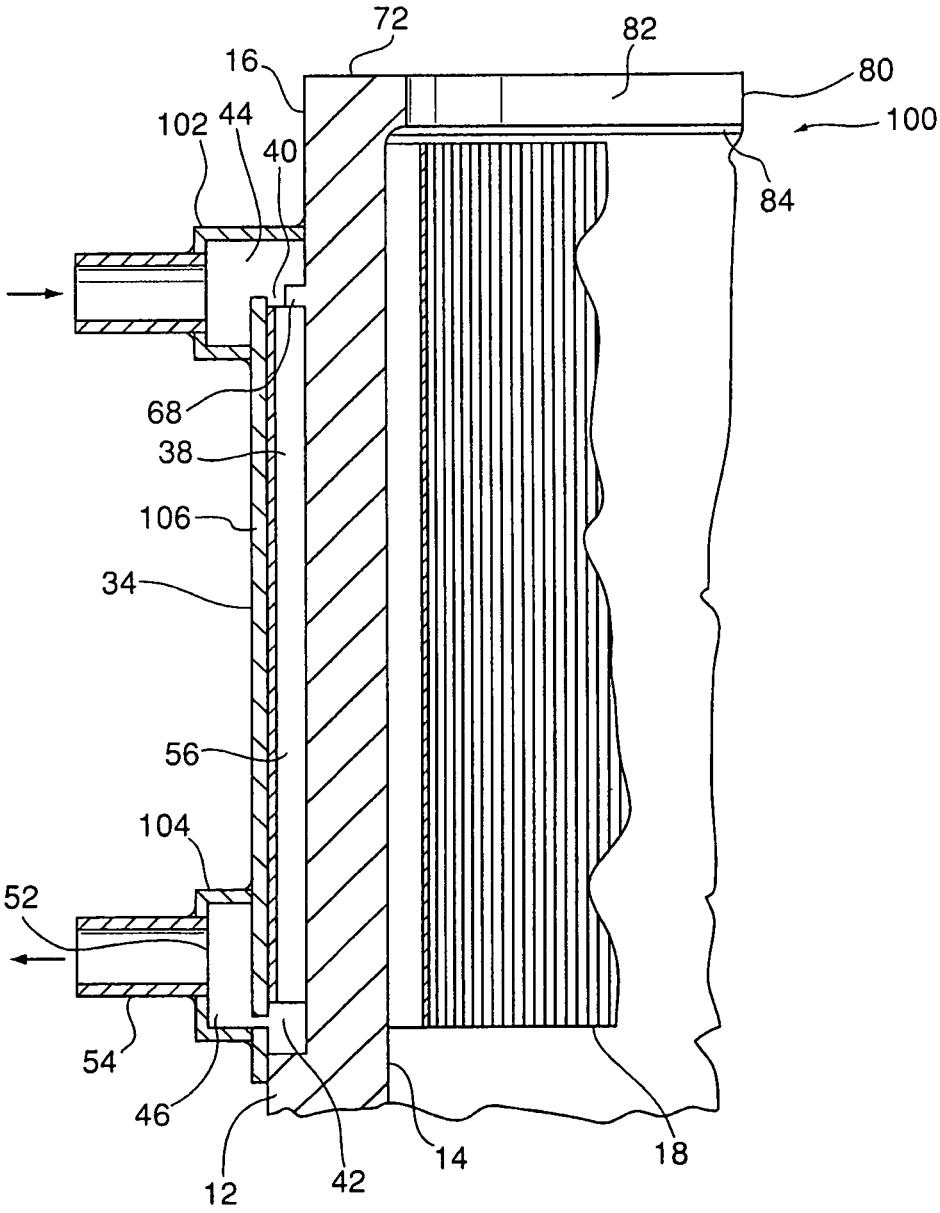
FIG. 6A is a partial cross-section, similar to FIG. 2, showing the sidewall construction of a heat exchanger according to variant of the second embodiment of the invention.
Figure 6B:
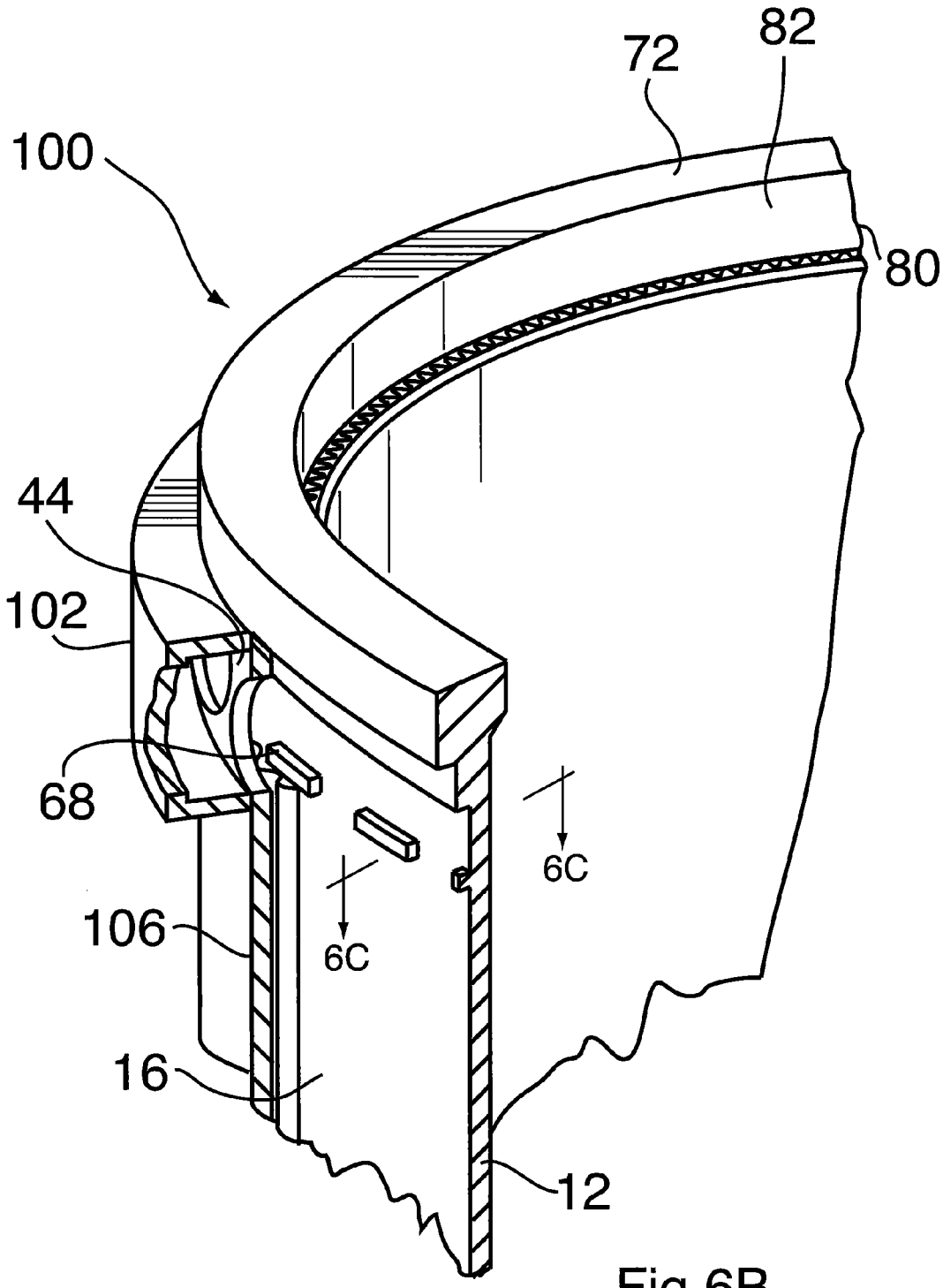
FIG. 6B is a partial, cutaway, detail perspective view illustrating a variant of a heat exchanger according to the present disclosure.
Figure 6C:
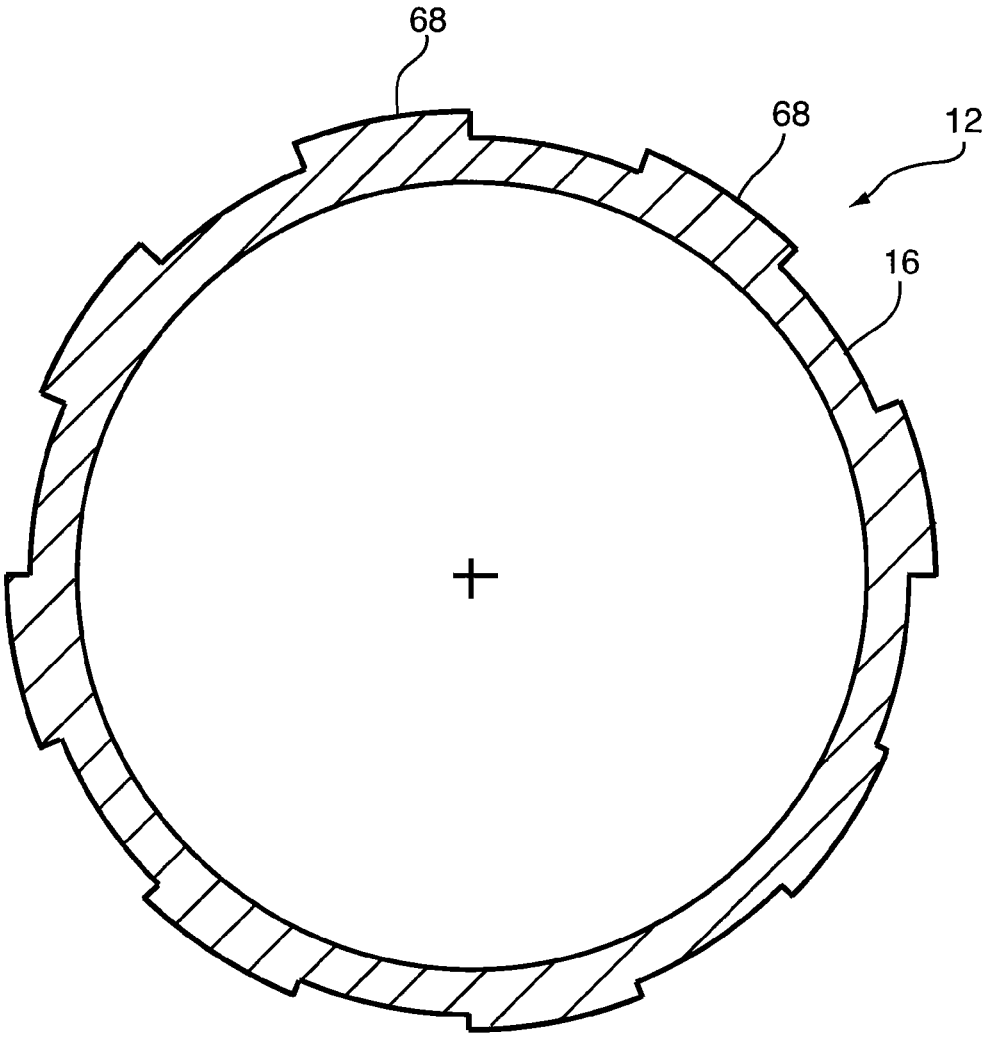
FIG. 6C is a top, section view of a portion of the middle wall of the heat exchanger shown in FIG. 6B taken along section line 6C-6C.
Figure 6D:
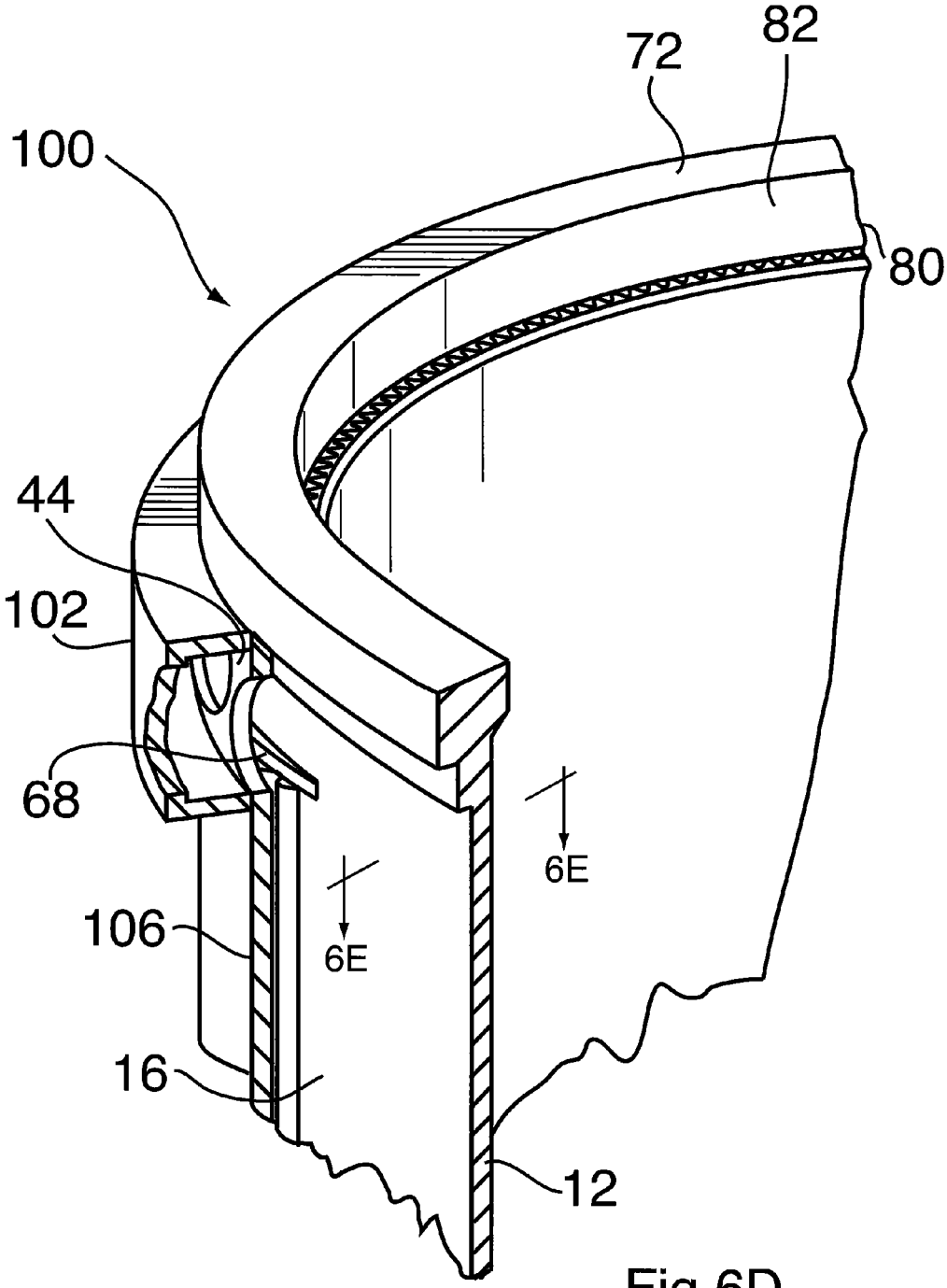
FIG. 6D is a partial, cutaway, detail perspective view illustrating a further variant of a heat exchanger according to the present disclosure.
Figure 6E:
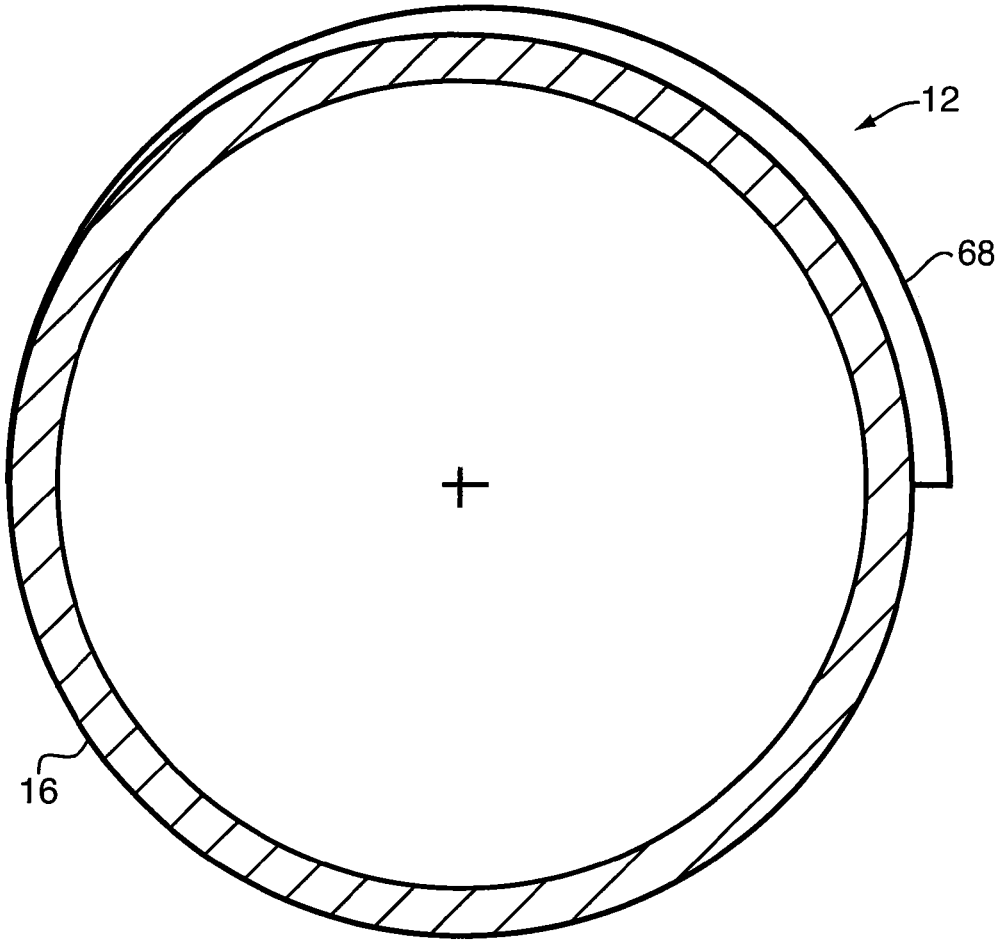
FIG. 6E is a top, section view of a portion of the middle wall of the heat exchanger shown in FIG. 6D taken along section line 6E-6E.

FIGS. 6 and 6A are partial cross-sectional views illustrating two variants of a heat exchanger 100 according to a second embodiment of the invention. Most of the components of heat exchanger 100 are similar or identical to components of heat exchanger 10 described above, and therefore like reference numerals are used to describe like components in the following description.

Heat exchanger 100 includes a middle wall 12, an inner wall 18 in the form of a corrugated fin which partially defines a first fluid flow passage 22, an outer wall 34, and an intermediate outer wall 56 in the form of a corrugated fin located within a second fluid flow passage 38 having open ends 40, 42. Rather than being smooth as in heat exchanger 10, however, the outer wall 34 of heat exchanger 100 is provided with radially projecting portions 102, 104 which define the respective manifolds 44 and 46. The radially projecting portions 102, 104 are separated by a smooth, cylindrical wall portion 106 of outer wall 34 which is in contact with or secured to the second ridges 60 of intermediate outer wall 56 and forms an outer wall of the second fluid flow passage 38.

The radially projecting portions 102, 104 are generally cylindrical and have approximately C-shaped cross-sections as shown in FIG. 6. In the construction shown in FIG. 6, the cross-sectional shape of middle wall 12 is substantially the same as that shown in FIG. 2, having radial ridges 64, 66 to which the cylindrical wall portion 106 is sealingly connected as by brazing or welding. Therefore, in the embodiment shown in FIG. 6, the cylindrical wall portion 106 has the same axial length as the outer wall 34 of heat exchanger 10 described above. The radially-projecting portions 102, 104 are sealingly connected to the cylindrical wall 106, proximate to its ends, to define manifolds 44, 46, with the sealed connections being formed by brazing or welding. The radially projecting portions 102, 104 function to increase the volumes of the manifolds 44, 46, thereby reducing the pressure drop of the liquid coolant as it flows through the heat exchanger 10.

As in heat exchanger 10, the manifolds 44, 46 of heat exchanger 100 are provided with fluid openings 48, 52 and fittings 50, 54, with only opening 52 and fitting 54 being visible in FIG. 6. The fitting 54 shown in FIG. 6 is configured to fit over and be sealingly secured to both the radially projecting portion 104 and cylindrical wall portion 106 of outer wall 34, as by brazing or welding. It will be appreciated that the fluid opening 52 is defined by an aperture or a gap in the radially projecting portion 104 which is in registration with the bore of the fitting 54. The other opening 48 and fitting 50 may be similarly configured.

Heat exchanger 100 may also be provided with means for restricting flow between the manifolds 44, 46 and the ends 40, 42 of the second fluid flow passage 38 for the purpose of achieving an optimal circumferential distribution of coolant in heat exchanger 100. In the embodiment shown in FIG. 6, for example, this flow restriction is provided by forming apertures 114 in the cylindrical wall portion 106 to provide fluid communication between the manifolds 44, 46 and the annular space 36 between middle wall 12 and cylindrical wall portion 106. The apertures 114 are therefore formed in portions of cylindrical wall portion 106 which are covered by the radially projecting portions 102, 104 of outer wall 34. One or more apertures 114 may be provided within each manifold 44 or 46, and in the embodiment shown in FIG. 6, a plurality of apertures 114 are formed in the portion of cylindrical wall portion 106 which is covered by radially projecting portion 102 and a plurality of apertures are also formed in the portion of cylindrical wall portion 106 covered by radially projecting portion 104. In this embodiment the size and spacing of the apertures 114 in cylindrical wall portion 106 are substantially constant about the circumference of heat exchanger 100. It will be appreciated, however, that the size and spacing of the apertures 114 may be increased or decreased so as to increase or decrease the flow restriction between manifolds 44, 46 and annular space 36, in order to optimize circumferential coolant distribution. It will also be appreciated that the size and/or spacing of apertures 114 may be varied along the circumference of heat exchanger 100, also to optimize the circumferential distribution of coolant.

In heat exchanger 6 of FIG. 6 the intermediate outer wall 56 does not substantially obstruct the apertures 114, although this is not necessarily the case. Rather, it will be appreciated that the intermediate outer wall 56 may obstruct a portion of the open area defined by apertures 114 so as to restrict coolant flow through apertures 114 and optimize circumferential distribution, as described above with reference to heat exchanger 10, with the wall 56 being of constant or variable length about its circumference. Heat exchanger 100 of FIG. 6 is also provided with ridges 68, 70 and a second inner wall 110, both of which are described above with reference to heat exchanger 10.

FIG. 6A illustrates a second variant of heat exchanger 100, which differs from that shown in FIG. 6 in a number of respects. For example, the intermediate outer wall 56 of heat exchanger 100 shown in FIG. 6A extends into the spaces occupied by the of heat exchanger 100 may preferably extend into the spaces defined by the radially projecting portions 102, 104 so as to maximize the area of the intermediate outer wall relative to the area of the outer surface 16 of middle wall 12, and is similar to the arrangement shown in FIG. 2A in this respect. Also, heat exchanger 100 is provided with a flow restricting rib 68 at the end 40 of second fluid flow passage 38 closest to the inlet opening 48, as in heat exchanger 10, in order to maximize circumferential distribution of the coolant throughout manifold 44. No locating rib 70 is provided in heat exchanger 100 of FIG. 6A, nor is a second inner wall 110.

It can be seen from FIG. 6A that the cylindrical wall 106 also extends into the spaces defined by radially projecting portions 102, 104, and terminates proximate to the ends of the intermediate outer wall 56. If desired, the cylindrical wall 106 may extend slightly past the ends of the intermediate outer wall 56, as shown in FIG. 6. The extension of the cylindrical wall 106 in this manner assists in diverting flow of coolant to the open ends of the intermediate outer wall so as to ensure that the coolant is in contact with the intermediate outer wall 56 throughout the entire length of the second fluid flow passage 38, thereby maximizing heat transfer. The cylindrical wall 106 may also restrict flow of coolant into the second fluid flow passage so as to optimize coolant distribution throughout manifolds 44, 46.

In the variant of heat exchanger 100 shown in FIG. 6A, the radially-projecting portions 102, 104 are sealingly connected to both the outer surface 16 of middle wall 12 and the to the ends of cylindrical wall 106 to define manifolds 44, 46, with the sealed connections being formed by brazing or welding. Also, in the variant of heat exchanger 100 shown in FIG. 6A, the openings 48, 52 and fittings 50, 54 are aligned with one another in the axial direction, such that the axial spacing between openings 48 and 52 is 0 degrees.

Figure 7:
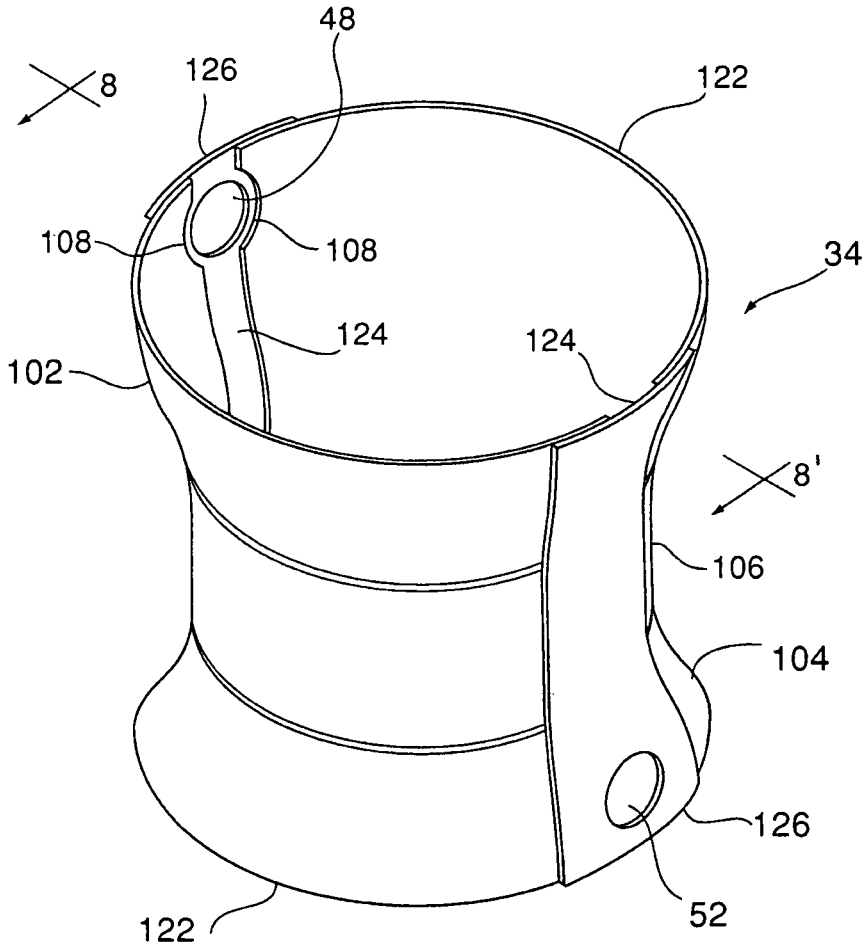
FIG. 7 illustrates a multi-piece outer wall construction for use in a heat exchanger according to a third embodiment of the invention.
Figure 8:
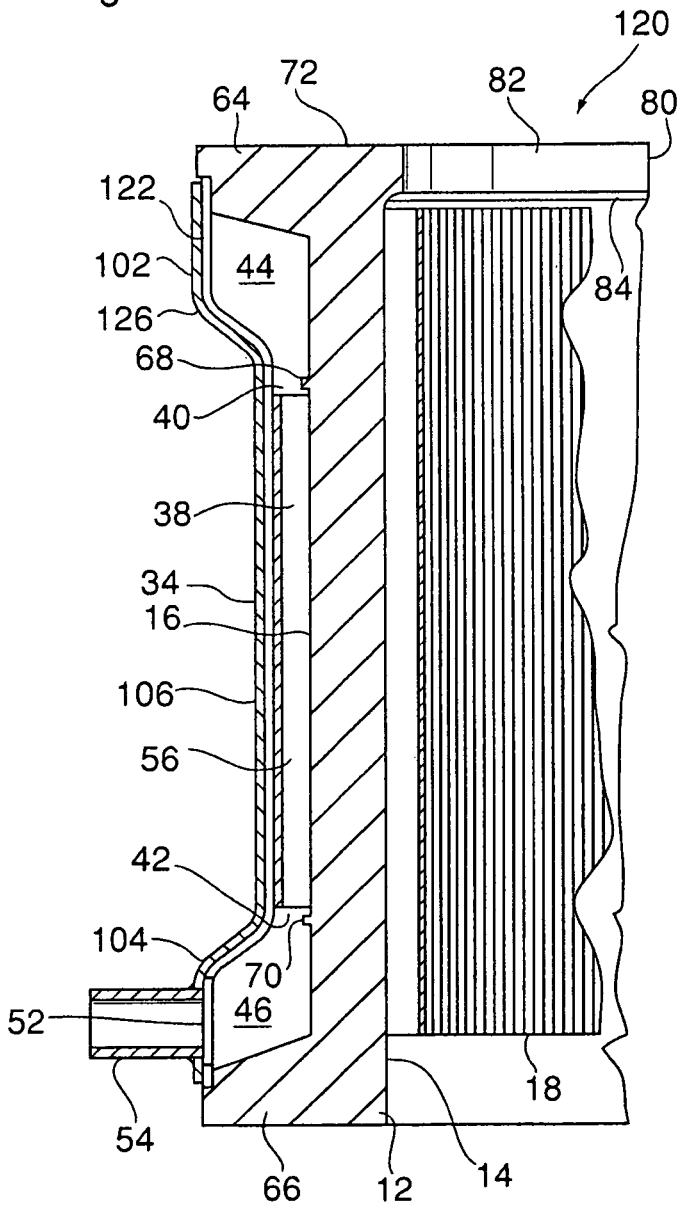
FIG. 8 is a partial cross-section, similar to FIG. 2, showing the sidewall construction of a heat exchanger according to the third embodiment of the invention, with the outer wall being sectioned along line 8-8' of FIG. 7.
Figure 8A:
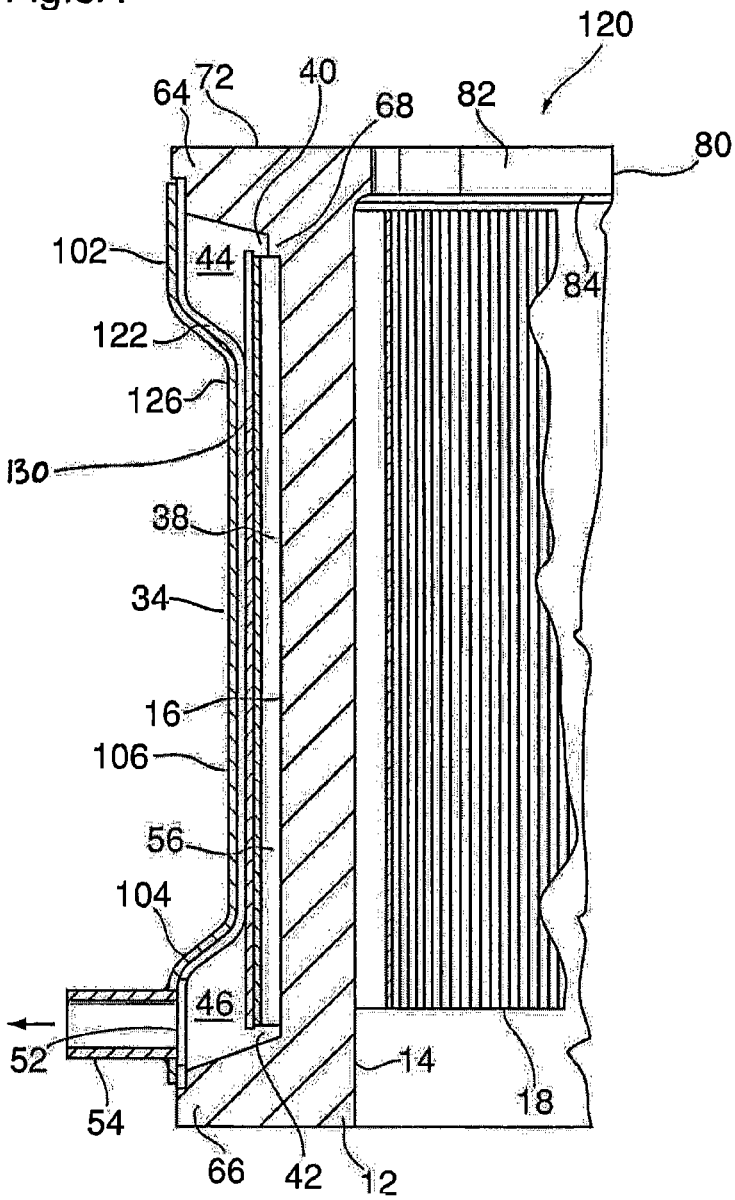
FIG. 8A is a cross-section, similar to FIG. 8, illustrating a variant of the third embodiment.

FIGS. 7, 8 and 8A illustrate a heat exchanger 120 according to a third embodiment of the invention. Most of the components of heat exchanger 120 are similar or identical to components of heat exchangers 10 and 100 described above, and therefore like reference numerals are used to describe like components in the following description of heat exchanger 100.

Like heat exchanger 100, the heat exchanger 120 has an outer wall 34 comprising radially projecting portions 102, 104 defining manifolds 44, 46, and a flat cylindrical portion 106 which forms an outer wall of the second fluid flow passage 38. Rather than being assembled by joining together a plurality of cylindrical sections, as in heat exchanger 100, the outer wall 34 of heat exchanger 120 is formed from a plurality of arc-shaped segments 122, with circumferentially-spaced, axially-extending joints 124 being provided between adjacent segments 122. In the embodiment shown in the drawings, the outer wall 34 is formed from two such segments 122, each of which is substantially semi-circular in transverse cross-section. The outer wall 34 therefore includes two joints 124 which are circumferentially spaced from one another by about 180 degrees.

The segments 122 are sealingly joined together by cover plates 126, each of which is sealed to the edges of two adjacent segments 122, for example by brazing or welding, so as to cover the joint 124 between the two segments 122. The cover plates 126 extend axially throughout the lengths of the segments 122 and are shaped to follow the contours of segments 122 so as to provide effective sealing contact along the edges of segments 122.

The segments 122 and cover plates 126 may be formed by one or more conventional stamping operations. Smooth transitions may be provided between the flat cylindrical portion 106 and the adjacent radially projecting portions 102, 104 of outer wall 34, thereby giving the outer wall an overall hourglass-like shape.

As with the heat exchangers 10 and 100 described above, the manifolds 44, 46 of heat exchanger 120 are provided with fluid openings 48, 52 which communicate with the second fluid flow passage 38. In the embodiment shown in the drawings, the fluid openings 48, 52 are formed in axially opposed ends of the respective cover plates 126, with semi-circular cutouts 108 being provided in the underlying segments 122 which register with the fluid openings 48, 52 in order to accommodate the fittings 50, 54, only one of which is shown in FIG. 8. It will be appreciated that each segment 122 may preferably be provided with four such cutouts 108, two along each edge proximate to both ends of the segment 122. Thus each segment is symmetrical about both longitudinal and transverse planes, which helps to simplify assembly of the heat exchanger 100.

Although the heat exchanger 100 has been described as having fluid openings 48, 52 provided in cover plates 126, it will be appreciated that this is not necessarily the case. In other embodiments of the invention, fluid openings 48, 52 may be located within the segments 122, between their edges, thereby eliminating the need for cutouts 108 and openings in the cover plates 126. Alternatively, where it is desired to have the fluid openings 48, 52 axially aligned with one another, one of the cover plates 126 may be provided with both openings 48, 52 while the other cover plate 126 is free of perforations.

As with heat exchanger 10, the outer surface 16 of middle wall 12 may be provided with a pair of radial ridges 64, 66 extending outwardly along the entire circumference of the middle wall 12, proximate to the open ends of the middle wall 12. The axially-spaced ends of outer wall 34 may overlap and be sealingly secured to the radial ridges 64, 66 in a fluid-tight manner, for example by brazing, thereby sealing the axially separated ends of the space occupied by the liquid coolant.

As in heat exchanger 100 described above, the heat exchanger 120 may be provided with elements for optimizing heat transfer and circumferential coolant distribution and these elements are described below with reference to FIG. 8A. In this variant of heat exchanger 100 the intermediate outer wall 56 extends into the spaces defined by radially projecting portions 102, 104 in order to maximize its surface area relative to the surface area of the outer surface 16 of middle wall 12, thereby maximizing heat transfer. For the purpose of optimizing circumferential coolant distribution, a flow restricting rib 68 is provided at the end of intermediate outer wall 56 closest to the inlet opening 48 (not shown) which is provided in the inlet manifold 44. No locating rib 70 is provided in the variant of heat exchanger 120 shown in FIG. 8A. Also provided in heat exchanger 120 is a second intermediate outer wall 130 which serves a function similar to that of cylindrical wall 106 in heat exchanger 100. In particular, the second intermediate outer wall 130 is a smooth, thin-walled cylindrical tube which is located between the intermediate outer wall 56 and the outer wall 34. The wall 130 is in contact with and secured to the cylindrical portion 106 of outer wall 34 and to the second ridges 60 of intermediate outer wall 56. The ends of wall 130 extend proximate to or slightly past the ends of the intermediate outer wall 56 so as to divert flow of coolant to the open ends of the intermediate outer wall 56 so as to ensure contact between the coolant and the intermediate outer wall 56 throughout the entire length of the second fluid flow passage 38, thereby maximizing heat transfer. The wall 130 may also restrict flow of coolant into the second fluid flow passage 38 so as to optimize coolant distribution throughout manifolds 44, 46.

Figure 9:
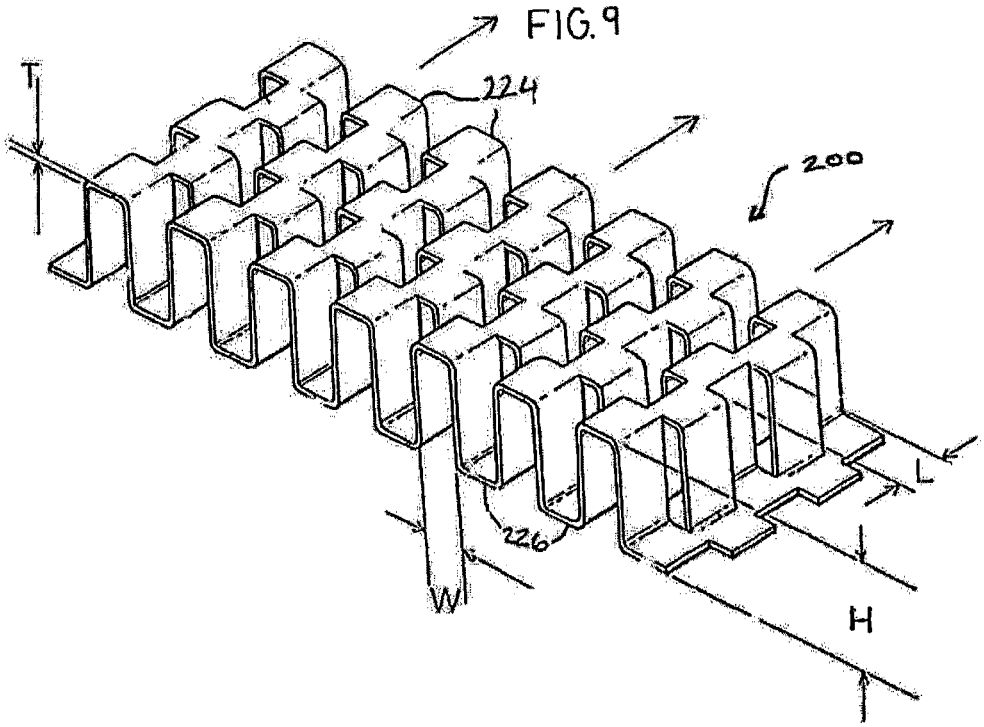
FIG. 9 is a perspective view of a portion of an offset strip fin in a flat or unwrapped form which can be adapted for use in the heat exchanger according to any one of the described embodiments.

Although the embodiments described above have walls 18, 56 in the form of corrugated fins enclosed within the first and second fluid flow passages 22, 38, it will be appreciated that this is not necessarily the case. Rather, the walls 18, 56 may instead comprise offset or lanced strip fins 200 of the type described in U.S. Pat. No. Re. 35,890 (So) and U.S. Pat. No. 6,273,183 (So et al.), an example of which is illustrated in FIG. 9. The patents to So and So et al. are incorporated herein by reference in their entireties. The offset strip fins may be received in the first and second fluid flow passages 22, 38 in exactly the same manner as described above for the walls 18, 56 formed from corrugated fins, such that the low pressure drop direction of the fin (i.e. with the fluid encountering the leading edges of the corrugations) is oriented in the axial direction. With the fin in this orientation there is a relatively low pressure drop in the axial flow direction and a relatively high pressure drop in the transverse, or circumferential, flow direction. In the offset strip fin 200 the axially-extending ridges 224, 226 defining the corrugations are interrupted along their length, so that the axially-extending spaces 20, 32, 36 (indicated in general by the arrows shown in FIG. 9) are tortuous. Therefore, the use of offset strip fins increases the turbulence of fluid flowing through the fluid flow passages 22, 38, thereby improving heat transfer. It will be appreciated, however, that an offset strip fin could instead be oriented such that the high pressure drop orientation of the fin (i.e. with the fluid encountering the side surfaces of the corrugations) is oriented in the axial direction. The high pressure drop orientation may be advantageous in some embodiments of the invention, for example to optimize circumferential coolant distribution. Other fin configurations may also be used to form walls 18, 56, such as louvered fins of the type described in U.S. Pat. No. 4,945,981 (Joshi), which is incorporated herein by reference in its entirety. Such louvered fins could also be oriented with either the low or high pressure drop direction being parallel to the direction of coolant flow, i.e. the axial direction. The walls 18, 56 could also be in the form of ruffled fins in which the ridges of the fin form a zig-zag pattern.

Although the walls 18, 56 have been described above as comprising corrugated fins with rounded crests, it will be appreciated that this is not necessarily the case. The fins may preferably have flat crests, although the use of flat-topped fins may have an adverse impact on heat transfer. It is preferred to use fins which maintain a relatively small area of contact with the walls 12, 34, 110 of the heat exchanger and/or with the housing 30 of the Stirling engine, thereby maximizing the area of the fin which is in contact with the working gas or the coolant. Therefore, the crests of the walls 18, 56 are preferably either rounded or angled so as to provide a relatively small area of contact with adjacent surfaces of heat exchanger 10 or housing 30.

The components making up the heat exchanger according to the invention may be made from a variety of materials, and the materials are preferably selected so as to maximize heat transfer, strength and durability. For example, the components of the heat exchanger can be formed from the same or different metals, such as aluminum, nickel, copper, titanium, alloys thereof, and steel or stainless steel.

Although the invention has been described with reference to certain preferred embodiments, it is not intended to be restricted thereto. Rather, the invention includes within its scope all embodiments which may fall within the scope of the following claims.

What is claimed is:

1. A heat exchanger, comprising:

(a) a cylindrical middle wall open at both ends extending along an axis between a first end and a second end, the middle wall having an outer surface and being free of perforations, the middle wall having a predetermined thickness;

(b) an inner wall located inwardly of the middle wall and being attached to the inner surface of the middle wall thereby providing one or more axially-extending spaces therebetween, wherein the inner wall is curved so as to follow the curvature of the middle wall, the inner wall defining an open interior space having opposed open ends, the open interior space adapted for receiving additional components of a heat exchanger system;

(c) a first fluid flow passage for the flow of a first fluid through the heat exchanger, the first fluid flow passage comprising the one or more axially-extending spaces formed between the inner wall and the middle wall, wherein the first fluid flow passage is open at its axially-spaced ends, the open axially-spaced ends of the first fluid flow passage being free of corresponding inlet and outlet manifolds thereby allowing the first fluid to flow axially through the first fluid flow passage;

(d) an outer wall located outwardly of the middle wall and being curved so as to follow the curvature of the middle wall, wherein one or more axially-extending spaces are provided between the middle wall and the outer wall, the outer wall sealing against the outer surface of the middle wall proximate to a first and a second end of the outer wall;

(e) a second fluid flow passage comprising the one or more axially-extending spaces formed between the middle wall and the outer wall, wherein the second fluid flow passage is open at its axially spaced ends, and said second fluid flow passage having a first annular open space at one of the axially spaced ends of the second fluid flow passage and a second annular open space at the other one of said axially spaced ends of the second fluid flow passage;

(f) a first manifold in flow communication with the first annular open end of the second fluid flow passage, the first manifold extending circumferentially around the outer surface of the first end of the middle wall, wherein the first manifold is provided with a first fluid opening;

(g) a second manifold in flow communication with the second annular open end of the second fluid flow passage, the second manifold extending circumferentially around the outer surface of the second end of the middle wall, wherein the second manifold is provided with a second fluid opening;

wherein the predetermined thickness of the middle wall is substantially greater than the thickness of the inner wall and of the outer wall, respectively, and wherein one of the first and second fluid openings serves as an inlet opening; and wherein a circumferentially-extending flow restricting rib is formed on and projects radially outwardly from the outer surface of the middle wall, the circumferentially-extending rib having a length that extends around the circumference of the outer surface of the middle wall, the length of the circumferentially-extending rib being greater than the width of the circumferentially-extending rib, wherein the width is the dimension in the radial direction of the heat exchanger, the circumferentially-extending rib being located proximate to and partially obstructing the annular open end of the second fluid flow passage that is closest to the inlet opening to fluid flowing in the axial direction, wherein the outward radial projection of the circumferentially-extending flow restricting rib varies along the circumference of the outer surface of the middle wall.

2. The heat exchanger according to claim 1, wherein the inner wall is generally cylindrical and is secured to the inner surface of the middle wall at a plurality of points along its circumference.

3. The heat exchanger according to claim 2, wherein the inner wall is comprised of a corrugated fin having a plurality of first axially-extending ridges, a plurality of second axially-extending ridges and a plurality of side walls interconnecting the first and second ridges, wherein the first set of ridges are located outwardly of the second ridges and are secured to the inner surface of the middle wall, such that a plurality of said axially-extending spaces are provided between the inner wall and the middle wall, wherein each of the axially-extending spaces is defined by the inner surface of the middle wall, a pair of adjacent side walls and one of the second ridges.

4. The heat exchanger according to claim 3, wherein each of the first and second ridges extends continuously between the ends of the first fluid flow passage.

5. The heat exchanger according to claim 3, wherein the inner wall is in the form of an offset strip fin in which the first and second ridges are interrupted along their length such that said axially-extending spaces are tortuous.

6. The heat exchanger according to claim 3, further comprising a second inner wall which is located inwardly of the inner wall and is secured to the second ridges of the inner wall, such that the first fluid flow passage is defined by an annular space between the middle wall and the second inner wall.

7. The heat exchanger according to claim 6, wherein the second inner wall is a smooth cylindrical wall which is free of perforations.

8. The heat exchanger according to claim 6, wherein the second inner wall has axially-spaced ends located proximate to the open ends of the middle wall, and wherein at least one of the axially-spaced ends of the second inner wall is provided with an inwardly-projecting portion which is adapted to contact a cylindrical component located inwardly of the second inner wall.

9. The heat exchanger according to claim 8, wherein both of the ends of the second inner wall are provided with one of said inwardly-projecting portions, and wherein one of said inwardly-projecting portions is provided with one or more openings.

10. The heat exchanger according to claim 1, wherein the inner surface of the middle wall is smooth.

11. The heat exchanger according to claim 1, wherein the middle wall is constructed so as to contain an inner gas pressure of at least about 40 bar.

12. The heat exchanger according to claim 1, wherein the outer wall is generally cylindrical such that the open ends of the second fluid flow passage and the manifolds are annular.

13. The heat exchanger according to claim 12, wherein the first and second fluid openings are circumferentially spaced from one another by about 180 degrees.

14. The heat exchanger according to claim 12, wherein the first and second fluid openings are axially aligned with one another.

15. The heat exchanger according to claim 12, wherein the outer wall is smooth and wherein the first and second fluid openings are formed at axially opposite ends of the outer wall.

16. The heat exchanger according to claim 1, wherein the outer surface of the middle wall is provided with radial ridges proximate to its ends, and wherein the outer wall is sealingly secured to the radial ridges.

17. The heat exchanger according to claim 1, wherein a corrugated fin is provided in said second fluid flow passage, wherein the corrugated fin has a plurality of first axially-extending ridges, a plurality of second axially-extending ridges and a plurality of side walls interconnecting the first and second ridges, wherein the first set of ridges are in contact with the outer surface of the middle wall and the second set of ridges is in contact with the outer wall.

18. The heat exchanger according to claim 17, wherein the corrugated fin extends around substantially the entire circumference of the middle wall.

19. The heat exchanger according to claim 17, wherein each of the manifolds is defined within an area enclosed by an outwardly projecting portion of the outer wall, and wherein the corrugated fin has axially-spaced ends which extend into the areas enclosed by the outwardly projecting portions.

20. The heat exchanger according to claim 19, wherein a smooth, cylindrical member is provided over substantially an entire area of the corrugated fin, having ends located proximate to the axially-spaced ends of the corrugated fin.

21. The heat exchanger according to claim 20, wherein said smooth, cylindrical member is at least partially defined by a cylindrical portion of the outer wall which is attached to the outwardly projecting portions of the outer wall.

22. A heat exchanger according to claim 19, wherein the outer wall is formed from two or more arc-shaped segments, wherein a plurality of circumferentially-spaced, axially-extending joints are provided between said segments.

23. A heat exchanger according to claim 22, wherein the outer wall is formed from two semi-circular segments, wherein a pair of axially-extending joints are provided between said segments.

24. A heat exchanger according to claim 23, wherein the outer wall further comprises cover plates to cover the joints between said segments, wherein each of the cover plates is sealingly secured to said two semi-circular segments.

25. A heat exchanger according to claim 24, wherein each of the cover plates is provided with one of said fluid openings.

26. A heat exchanger according to claim 24, wherein one of the cover plates is provided with both of said fluid openings, and wherein the other of the cover plates is free of perforations.

27. The heat exchanger as claimed in claim 1, wherein the circumferentially-extending flow restricting rib is discontinuous around the circumference of the middle wall.

* * * * *